United States Patent [19]

Cantada

[11] 4,426,943

[45] Jan. 24, 1984

[54] ADJUSTABLE CUSHIONING SPRING FOR A SEWING MACHINE

[75] Inventor: Edilberto Cantada, East Brunswick, N.J.

[73] Assignee: The Singer Company, Stamford, Conn.

[21] Appl. No.: 375,923

[22] Filed: May 7, 1982

[51] Int. Cl.[3] ..... D05B 3/02

[52] U.S. Cl. ..... 112/221

[58] Field of Search ..... 112/221, 158 R, 158 A, 112/78, 79 R, 163, 167, 237–239; 267/179, 166

[56] References Cited

U.S. PATENT DOCUMENTS

| | | | |
|---|---|---|---|
| 2,166,426 | 7/1939 | Dickson | 267/179 X |
| 3,266,449 | 8/1966 | Berg et al. . | |
| 3,387,579 | 6/1968 | Ciccotelli, Jr. . | |
| 3,476,147 | 11/1969 | Hitt et al. | 267/166 X |
| 3,727,568 | 4/1973 | Graham . | |
| 3,782,311 | 1/1974 | Adams et al. | 112/158 R |
| 3,799,090 | 3/1974 | Sheroff . | |

FOREIGN PATENT DOCUMENTS 54-65248 10/1977 Japan .

*Primary Examiner*—Werner H. Schroeder
*Assistant Examiner*—Andrew M. Falik
*Attorney, Agent, or Firm*—William V. Ebs; Robert E. Smith; Edward L. Bell

[57] ABSTRACT

Skip stitch mechanism for a sewing machine is provided with a coiled needle bar cushioning spring which mounts in axial alignment with the needle bar on the upper arm of a movable gate and which can be adjustably positioned on the gate arm to define a position from which the needle bar may be latched to reciprocating drive means.

5 Claims, 6 Drawing Figures

ADJUSTABLE CUSHIONING SPRING FOR A SEWING MACHINE

BACKGROUND OF THE INVENTION

1. Field of the Invention

The invention relates to skip stitch sewing machines which include needle bar latching and releasing mechanisms.

2. Description of the Prior Art

Skip stitch mechanisms, such as shown for example, in U.S. Pat. No. 3,782,311 of Kenneth D. Adams and Salvatori A. D'Orio for "Simplified Basting Stitch Mechanism" issued Jan. 1, 1974, and in U.S. Pat. No. 4,312,284 of Kenneth D. Adams for "Needle Bar Deflecting Arrangement for a Skip Stitch Sewing Machine" issued Jan. 26, 1982, include a normally engaged needle bar latch which is opened whenever the needle bar is jogged by a gate to a predetermined maximum lateral position on one side of a central needle bar position. The needle bar is thereby disconnected from actuating mechanism for imparting endwise reciprocatory motion thereto and a skipped stitch results. When the latch is opened to disconnect the needle from the actuating mechanism, the needle bar is drawn upward by an elevating spring into a limited position from which the needle bar may subsequently be reconnected to the actuating mechanism. The limited position is defined by a cantilevered spring with an arm which is normally supported in a flexed condition on an adjustable bracket and which projects therefrom to engage needle bar affixed structure at an offcenter location relative to the needle bar axis when the unlatched needle bar is drawn upwardly by the elevating spring. The cantilevered spring brings the needle bar to an abrupt halt. The spring therefor does little to cushion movement of the needle bar into the limited upward position and an undesirable level of impact noise is experienced as a result. The unsymmertical loading of the needle bar by engagement of the spring arm with the needle bar affixed structure also results in the production of undesirable noise during operation of the skip stitch mechanism.

It is a prime object of the present invention to provide a coiled needle bar cushioning spring which mounts upon the movable gate of a skip stitch sewing machine in axial alignment with the needle bar axis, and which can be positionally adjusted as a unit to predetermine a limited upward position for the needle bar when unlatched from actuating mechanism.

It is another object of the invention to provide an adjustable cushioning spring arrangement as described which is effective in sewing machines to minimize noise due to the operation of skip stitch mechanism.

It is also an object of the invention to provide an adjustable cushioning spring arrangement which can be economically produced and easily assembled into a machine.

Other objects and advantages of the invention will become apparent during a reading of the specification taken in connection with the accompanying drawings.

SUMMARY OF THE INVENTION

Skip stitch mechanism in a sewing machine is provided according to the invention with a needle bar cushioning coil spring which is affixed at one end to a member that is adjustable on a movable gate wherein the needle bar is supported for endwise reciprocation. The spring affixed member holds the spring in axial alignment with the needle bar and can be selectively positioned along the axial line of the needle bar to predetermine a location for the spring defining a limited upward position for the needle bar when unlatched from needle bar actuating mechanism to provide for skip stitching.

DESCRIPTION OF THE PREFERRED EMBODIMENT

Figure 1:
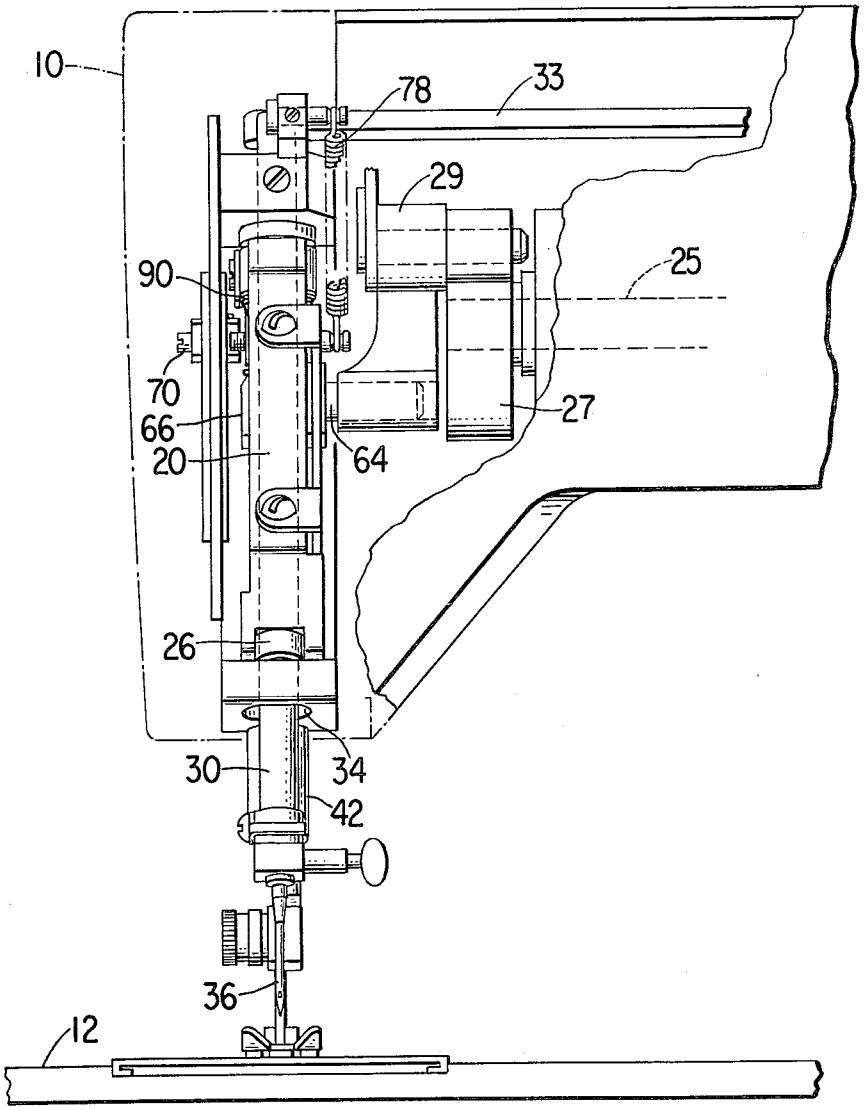
FIG. 1 is a front elevational view of the head end portion of a sewing machine incorporating the cushioning spring arrangement of the invention.
Figure 2:
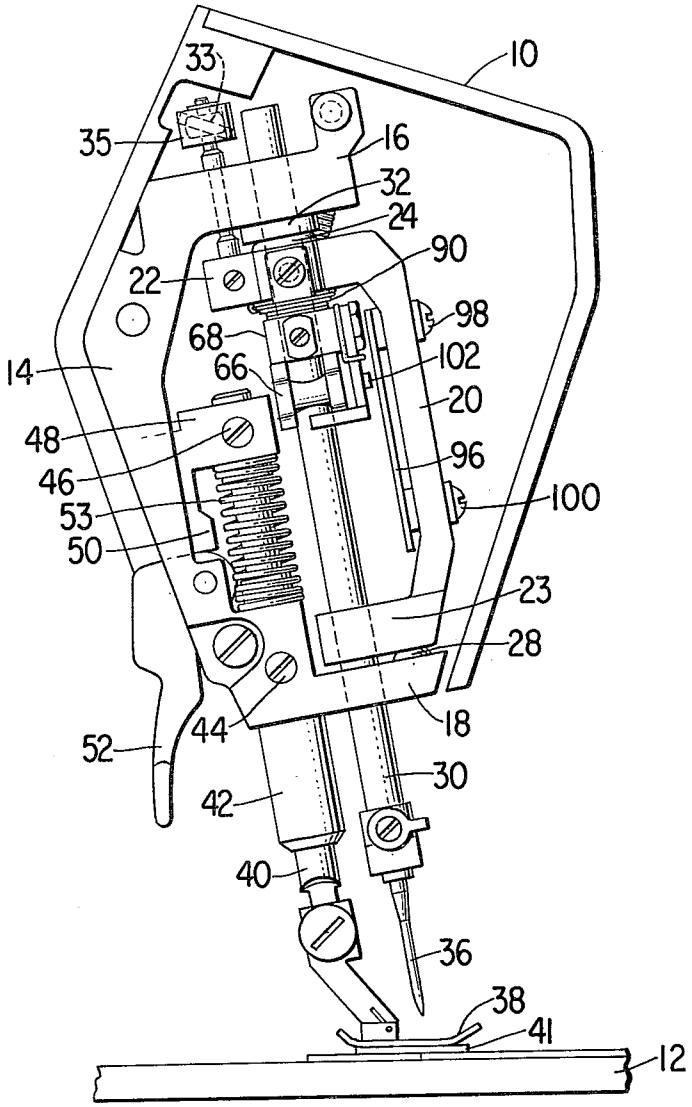
FIG. 2 is an end elevational view of the head end portion of the machine from which the end cover and an end face plate have been removed.
Figure 5:
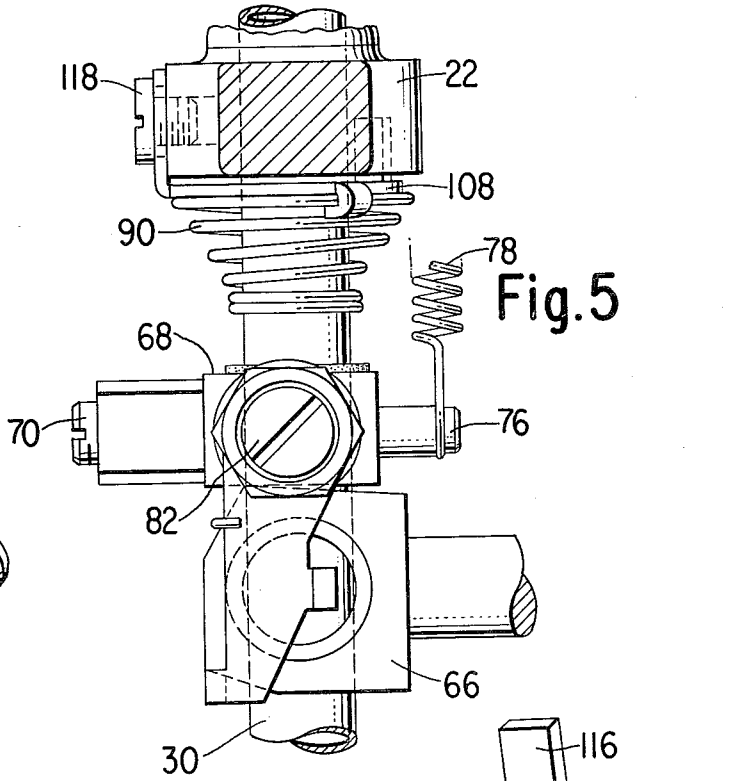
FIG. 5 is a fragmentary front elevational view showing the cushioning spring, and the latch mechanism connected to the reciprocating drive means.
Figure 6:
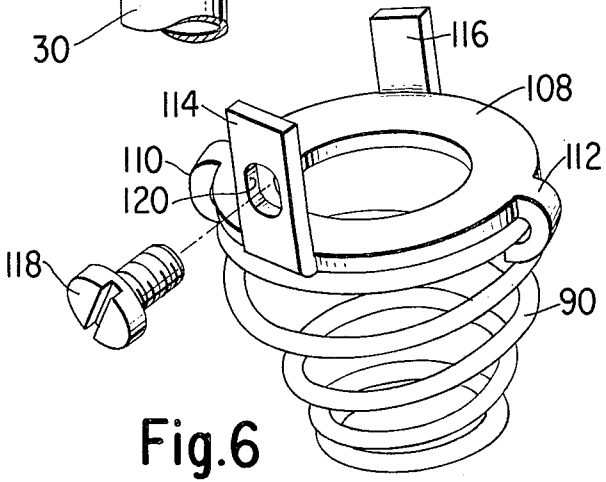
FIG. 6 is an enlarged perspective view showing the cushioning spring.
Figure 4:
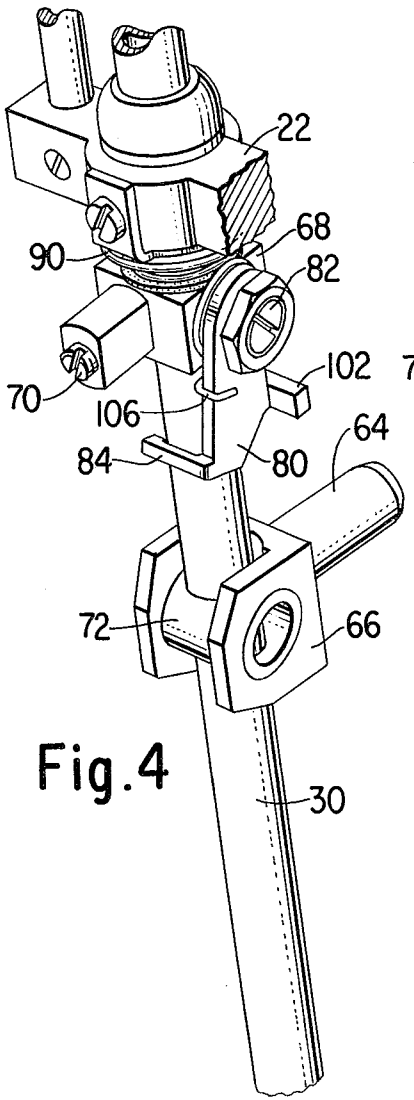
FIG. 4 is a fragmentary perspective view showing a cushioning spring arranged according to the invention, and showing needle bar latch mechanism detached from needle reciprocating drive means.
Figure 3:
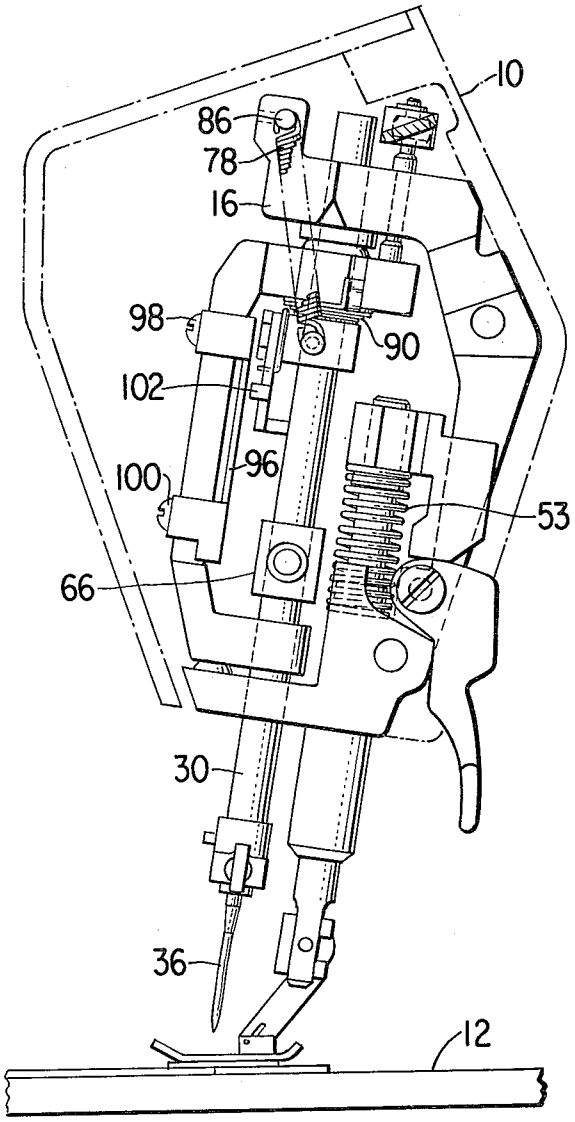
FIG. 3 is an elevational view of the head end portion of the machine as viewed from the interior of the machine in a direction opposite to that of FIG. 2.

Referring to the drawings, reference characters 10 and 12 designate the head end portion and a work supporting bed portion respectively of a skip stitch sewing machine. As shown, head end portion 12 includes a fixed support bracket 14 having an upper extending arm 16, and having a lower extending arm 18 wherein a gate 20 is journalled. Gate 20 includes an upper rearwardly extending arm 22 and lower rearwardly extending arm 23. Inserted in the upper arm of the gate 20 is an upper bearing 24 having an outer spherical surface and a coaxial internal bearing surface. Inserted into the lower arm of the gate is a bearing 26 having both an internal bearing surface, and spaced therefrom a socket. A spherical headed rivet 28 affixed to the lower arm 18 of the support bracket 14 has its spherical head protruding into the socket.

A needle bar 30 is supported for endwise reciprocation by a rotating arm shaft 25 acting through a crank 27 and link 29. As shown, the needle bar 30 is supported in the internal bearing surface of the upper bearing in the upper arm of the gate 20 and in the internal bearing surface of the lower bearing in the lower arm of the gate. A socket bearing 32, having an internal clearance hole for the needle bar 30, is mounted in a bore in the upper arm 16 of the support bracket 14 and provides the socket for the outer spherical surface of the upper bearing 24 mounted in the upper arm 22 of gate 20. The needle bar 30 extends through an elongated opening 34 in the lower arm 18 of support bracket 14 which provides lateral clearance for the needle bar. The gate and needle bar are laterally movable by a link 33 on a needle bar post 35 in opposite directions for zig-zag sewing, and to a position beyond the zig-zagging range for skip stitching. Link 33 may be operable by cam means as in the manner indicated in U.S. Pat. No. 3,559,601 of The Singer Company issued Feb. 2, 1971, or by a servomotor as in the manner indicated in U.S. Pat. No. 3,984,745 of The Singer Company issued Oct. 5, 1976.

Attached to the lower end of the needle bar 30 is a needle 36 which cooperates with a loop taker (not shown) in the bed portion 12 of the machine. A presser foot 38, affixed to a presser bar 40, serves to urge work material into contact with a feed dog 41. The presser bar is journalled in a bearing 42 which is affixed in a bore in the support bracket 14 by a screw 44. The upper end of the presser bar 40 is affixed to by a screw 46 to a presser bar guide block 48. Such guide block 48 has a tang portion 50 slidable in a slot in the support bracket 14 to prevent undesirable rotation of the presser foot 38. The tang portion 50 of the presser guide block 48 also coacts with a presser bar lifting lever 52, journalled on the support bracket 14, to raise the presser foot from contact with the work material in the usual manner. Pressure exerted by the foot 38 on work material is controlled by tensioned spring 53.

As shown, link 29 connects through a driving stud 64 with a drive link 66 which may be latched to or unlatched from a latch carrier block 68 that is affixed to a needle bar 30 by a screw 70. The drive link 66 includes a collar 72 freely slidable on the needle bar 30 when the drive link 66 is unlatched from the block 68. On the opposite side of block 68 from screw 70, a pin 76 protrudes sufficiently to catch the hook end of a spring 78. On the forwardly disposed face of the block 68, a latch 80 pivots on a shouldered screw 82. The latch 80 is fashioned with a rearwardly directed latch finger 84 to extend beneath and clasp the drive link 66 to the block 68 affixed to the needle bar. A second hook end of spring 78 is attached to a fixed member 86. The spring 78 serves to lift the latch carrier block 68 and needle bar 30 to an elevated position whenever the latch 80 is disengaged from link 66. The height to which the latch carrier and needle bar may be carried is limited by a cushioning spring 90 which is mounted on the upper arm 22 of gate 20 as hereinafter described.

Normally the drive link 66 is latched to block 68 and the needle bar is reciprocated by the associated driving means whether the needle bar is in a central straight stitching position (FIG. 1 position), or is oscillated for zig-zag stitching. However, gate 20 is provided with a latch release abutment member 96 as disclosed in the aforementioned U.S. Pat No. 3,782,311 for disconnecting latch 80 and thereby the needle bar reciprocating drive from the needle bar whenever the needle bar 30 is moved by link 33 acting upon gate 20 into a skip stitch position for needle 36.

The latch release abutment member 96 which is adjustably attached to the gate 20 by screws 98 and 100 extends adjacent a forwardly extending ear 102 on latch 80. As described in the said U.S. Pat. No. 3,782,311, when the gate is moved (to the left as viewed in FIG. 1), beyond a maximum bight position for needle 36 to a skip stitch position, abutment member 96 is disposed to strike forwardly extending ear 102 on latch 80 moving to the right with the needle bar and uncouple the latch from the needle bar reciprocating drive thereby causing the needle bar to be drawn upwardly by spring 78 until block 68 on the needle bar impacts against the cushioning spring 90. As contact between the abutment member 96 and forwardly extending ear 102 of the latch 80 is eliminated by movement of the gate to the right, the latch is rotated by torsion spring 106. When the block 68 reaches the latch 80 held in the relatching position by spring 78, connection is again made to the needle bar reciprocating drive to initiate reciprocation of the needle bar.

As shown, cushioning spring 90 extends under a ring 108 where the coils taper from a maximum diameter at the ring to a minimum diameter at the bottom end of the spring. The ring 108 is affixed to the spring 90 by means of downturned tabs 110 and 112 which are clamped over the upper end coil of the spring. The ring includes diametrically opposide upstanding ears 114 and 116 which engagingly embrace the gate arm 22. Preferably, the ring is formed as a sheet metal stamping with the tabs 110 and 112, and the ears 114 and 116 as integral parts of the structure. A screw 118 extending through an elongate slot 120 in ear 114 and into the gate arm secures the ring 108 and thereby the spring to the gate in axial alignment with the needle bar 30. The ring 108 and spring 90 are positioned along the axial line of the needle bar and spring by sliding the ring on loosened screw 118 extending through the elongate slot 120. The screw, when tightened, predetermines a limited upward position into which the needle bar may be drawn by spring 78 when unlatched from actuating mechanism, and from which the needle bar may be relatched to the reciprocating drive means. Since the coils of spring 90 are coaxial with respect to the needle bar 30 and the needle bar extends through the coils as shown, the spring loads the needle bar centrally when engaged by block 68.

It is to be understood that the present disclosure relates to a preferred embodiment of the invention which is for purposes of illustration only and is not to be construed as a limitation of the invention. Numerous alterations and modifications of the structure herein disclosed will suggest themselves to those skilled in the art, and all such modifications and alterations which do not depart from the spirit and scope of the invention are intended to be included within the scope of the appended claims.

I claim:

1. In a sewing machine, a needle bar, a movable gate including an arm in which the needle bar is supported for endwise reciprocation, latching means carried on the needle bar, actuating means for imparting endwise recirpocatory motion to the needle bar through said latching means, means for unlatching the latching means from said actuating means, elevating spring means for raising the needle bar when unlatched from the actuating means, a fixed member on the needle bar, a cushioning coil spring disposed coaxially with respect to the needle bar for engagement by said fixed member, and a ring which is affixed to the cushioning spring, the ring including an upstanding ear, said ring being adjustable on the gate and being securable thereto with a fastener extending through the ear for affixing the cushioning spring is a selected longitudinal position along the axis of the needle bar.

2. The combination of claim 1 wherein the fastner extends through an elongated hole in said ear permitting longitudinal adjustment of the cushioning cushioning coil spring along its axis.

3. The combination of claim 1 wherein the ring affixed to the cushioning spring is a sheet metal stamping which is crimped to an end coil of the cushioning spring.

4. The combination of claim 1 wherein the ring includes another upstanding ear, and the ears thereon embrace the gate arm to guide adjusting movements of cushioning spring.

5. The combination of claim 4 wherein said upstanding ear are a pair of diametrically opposite ears on the ring.

* * * * *